US006530636B1

(12) United States Patent
Asauchi

(10) Patent No.: US 6,530,636 B1
(45) Date of Patent: Mar. 11, 2003

(54) INK JET RECORDING APPARATUS AND INK JET RECORDING METHOD

(75) Inventor: Noboru Asauchi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/639,997

(22) Filed: Aug. 17, 2000

(30) Foreign Application Priority Data

Aug. 18, 1999 (JP) ..... 11-231740
Sep. 9, 1999 (JP) ..... 11-255622

(51) Int. Cl.[7] ..... B41J 29/38; B41J 29/393
(52) U.S. Cl. ..... 347/14; 347/19
(58) Field of Search ..... 347/19, 14

(56) References Cited

U.S. PATENT DOCUMENTS 5,482,390 A 1/1996 Murakami et al. ..... 400/636.2

FOREIGN PATENT DOCUMENTS

EP 0 475 638 3/1992
EP 0 481 625 4/1992
EP 0 626 265 11/1994
EP 0 844 094 5/1998

OTHER PUBLICATIONS

European Search Report dated Apr. 4, 2001.

*Primary Examiner*—Thinh Nguyen
(74) *Attorney, Agent, or Firm*—Sughrue Mion, PLLC

(57) ABSTRACT

There is disclosed an ink jet recording apparatus in which temperature of a recording head is detected at a timing adapted for an actual recording operation, and temperature correction is performed on the basis of a detection result, so that the recording head can be driven on optimum drive conditions. The ink jet recording apparatus of the present invention has a detection timing controller. On the basis of detection judgment results of a cut sheet detection sensor and a continuous sheet detection sensor, the detection timing controller allows a temperature sensor to detect the temperature of the recording head by each page when a recording medium is a cut sheet, and allows the temperature sensor to detect the temperature of the recording head by every predetermined number of raster, which is, for example, a raster unit treated as one page after sheet cutting when the recording medium is a continuous sheet.

21 Claims, 12 Drawing Sheets

INK JET RECORDING APPARATUS AND INK JET RECORDING METHOD

CROSS REFERENCE TO RELATED APPLICATIONS

The subject application is related to subject matter disclosed in Japanese Patent Applications No. H11-231740 filed on Aug. 18, 1999 and H11-255622 filed on Sep. 9, 1999 in Japan to which the subject application claims priority under Paris Convention and which is incorporated herein by reference.

BACKGROUND OF THE INVENTION

1. Field of the Invention

The present invention relates to an ink jet recording apparatus such as an ink jet printer or an ink jet plotter, particularly to a technique of performing temperature correction for drive conditions of a recording head.

2. Related Background Art

In a certain kind of recording head of an ink jet recording apparatus such as an ink jet printer or an ink jet plotter, there are a plurality of pressure generation elements such as piezoelectric vibrators (e.g., piezoelectric elements) corresponding to a plurality of nozzle openings, respectively. These pressure generation elements discharge ink droplets through the nozzle openings, when ink in a pressure generation chamber connected to the nozzle openings is pressurized.

In this type of ink jet recording apparatus, while the discharge of the ink is repeated, the recording head causes a temperature rise, so that an ink viscosity changes. As a result, an ink discharge amount fluctuates, thereby deteriorating a recording quality. Therefore, there has been taken a measure of detecting a temperature of the recording head and changing a drive waveform and a drive voltage on the basis of the temperature detection result, or another measure.

However, in a conventional temperature correction method of the ink jet recording apparatus, the recording head temperature is detected by every constant time, and an actual recording operation is not correlated with a temperature detection timing. Therefore, there is a problem that when a data transfer timing overlaps the temperature detection timing, the data transfer timing is delayed, so that a recording throughput has to be sacrificed.

Moreover, in the ink jet recording apparatus, not only an A4 sheet or another cut sheet, but also a rolled sheet or another continuous sheet are used as a recording medium, but in the conventional ink jet recording apparatus, the temperature correction of the recording head is not performed for each type of the recording sheet at an optimum timing.

Furthermore, temperature changes of the recording head include not only a temperature rise but also a temperature drop during discontinuance of discharging of the ink droplets, but with respect to the temperature drop, the conventional ink jet recording apparatus has a problem that no temperature correction is performed at an adequate timing.

SUMMARY OF THE INVENTION

In consideration of the aforementioned problems, an object of the present invention is to provide an ink jet recording apparatus and an ink jet recording method in which a recording head temperature is detected at a timing adapted for an actual recording operation, and a temperature correction is performed on the basis of the detection result, so that a recording head can be driven on optimum drive conditions.

To achieve the aforementioned object, there is provided an ink jet recording apparatus comprising:

- a recording head in which when a plurality of pressure generation elements corresponding to a plurality of nozzle openings, respectively, pressurize ink in a pressure generation chamber connected to the nozzle openings, ink droplets are discharged to a recording medium via the nozzle opening;
- temperature detection means for detecting a temperature of the recording head;
- detection timing control means for allowing the temperature detection means to detect the temperature of the recording head at a predetermined timing;
- temperature correction means for performing temperature correction for drive conditions of the recording head from the nozzle opening on the basis of a temperature detection result by the temperature detection means; and
- recording stop monitor means for monitoring whether the discharging of the ink droplets is stopped or not.

On the basis of a monitor result of the recording stop monitor means, when the discharging of the ink droplets is stopped, the detection timing control means allows the temperature detection means to detect the temperature of the recording head until the discharging of the ink droplets starts.

According to the present invention, when the discharging of the ink droplets stops, the recording head temperature is detected and temperature correction is performed. Therefore, even when the recording head temperature drops by discontinuance of discharging of the ink droplets and the ink viscosity rises, ink droplet discharge conditions are corrected, so that viscosity changes are canceled out. Consequently, there is little likelihood that a weight of ink droplets fluctuates, and it is possible to perform recording with a high print quality.

Moreover, there is provided an ink jet recording apparatus comprising:

- a recording head in which when a plurality of pressure generation elements corresponding to a plurality of nozzle openings, respectively, pressurize ink in a pressure generation chamber connected to the nozzle opening, ink droplets are discharged to a recording medium via the nozzle opening;
- drive signal generation means for generating a drive signal to be applied to the pressure generation element;
- temperature detection means for detecting a temperature of the recording head;
- detection timing control means for allowing the temperature detection means to detect the temperature of the recording head at a predetermined timing; and
- temperature correction means for performing temperature correction for drive conditions of the recording head on the basis of a temperature detection result by the temperature detection means.

The detection timing control means allows the temperature detection of the recording head to be performed every predetermined raster number.

Moreover, in the ink jet recording apparatus according to the present invention, for example, when recording is performed on an A4 cut sheet, time for feeding a sheet after finishing the recording of one page is utilized to allow the temperature detection means to detect the temperature.

In this manner, the temperature detection means can detect the temperature while avoiding the time for performing the recording operation and data transfer. Therefore, a processing for temperature correction does not prevent another printing operation, thereby improving recording throughput.

DESCRIPTION OF THE PREFERRED EMBODIMENTS

An embodiment of an ink jet recording apparatus according to the present invention will be described hereinafter with reference to the drawings.

Entire Constitution of Ink Jet Recording Apparatus

Figure 1:
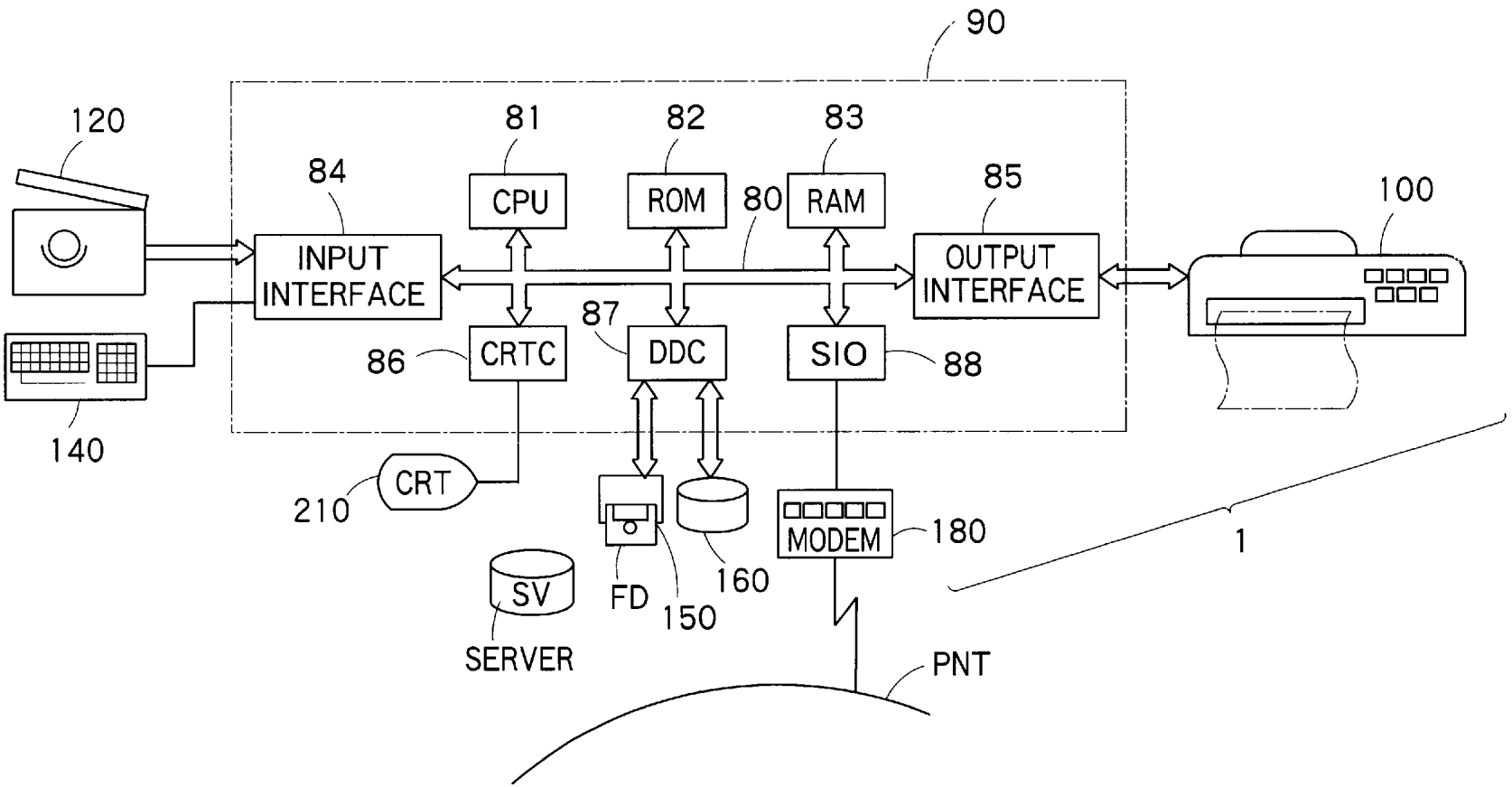
FIG. 1 is a block diagram showing the entire configuration of an ink jet recording apparatus to which the present invention is applied.

FIG. 1 is a block diagram showing the entire configuration of the ink jet recording apparatus according to the present invention.

As shown in FIG. 1, an ink jet recording apparatus 1 of the present embodiment is provided with an ink jet printer 100 capable of performing color printing, and a computer 90 for transmitting recording information for printing to the ink jet printer. The computer 90 of FIG. 1 is connected to a scanner 120, but the scanner 120 is not necessarily essential.

The computer 90 has a CPU 81 for carrying out various calculation processings relating to an image processing in accordance with a program stored in ROM 82, or the like. The CPU 81 is connected to ROM 82, RAM 83, input interface 84, output interface 85, CRTC 86 for image control, disk controller (DDC) 87, SIO 88 for communication control, and the like, via a bus 80.

The ROM 82 pre-stores programs and data necessary to carry out various calculation processings by the CPU 81. The RAM 83 temporarily stores various programs and data necessary to carry out various calculation processings by the CPU 81.

The input interface 84 performs control to take signals from the scanner 120 or a keyboard 140. The output interface 85 performs control to output the recording information for printing to the ink jet printer 100.

The CRTC 86 performs display control of a CRT 210 on which color display is possible. The DDC 87 controls data transmission/reception with external recording media such as a hard disk 160, a flexible drive 150, and a CD-ROMdrive (not shown). The hard disk 160 stores various programs loaded and executed on the RAM 83, various programs provided in the form of a device driver, various programs provided in the form of a disk driver, and the like.

Additionally, the bus 80 is connected to the serial input interface (SIO) 88. The SIO 88 is connected to a modem 180, and connected to a public telephone circuit PNT via the modem 180. The computer 90 may be connected to an external network via the SIO 88 or the modem 180. In this case, a specific server SV connected to the network can download the program necessary for the image processing to the hard disk. Moreover, the necessary program can also be downloaded from a flexible disk FD or CD-ROM, and executed by the computer 90.

Figure 2:
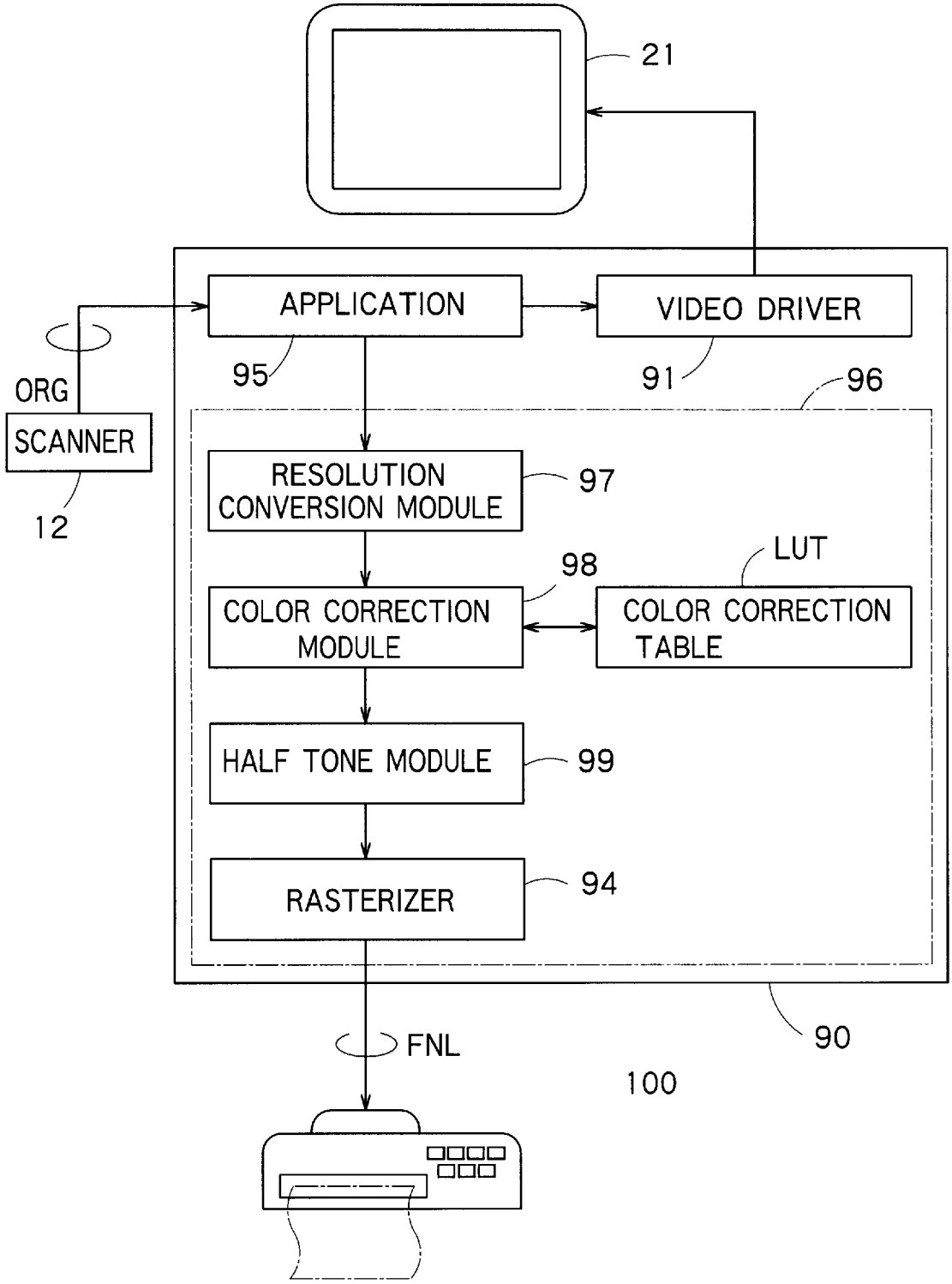
FIG. 2 is a block diagram showing a software configuration of the ink jet recording apparatus shown in FIG. 1.

FIG. 2 is a block diagram showing a software configuration of the ink jet recording apparatus of the present embodiment.

The computer 90 executes an application program 95 under a predetermined operating system. The operating system incorporates a video driver 91 and a printer driver 96. The application program 95 outputs intermediate image data to be transferred to the ink jet printer 100 via these drivers 91, 96.

For example, the application program 95 for retouching an image performs a predetermined processing with respect to original color image data constituted of three color components of red (R), green (G), blue (B) read from a scanner 12, and displays the image on a CRT display 21 via the video driver 91.

When the application program 95 issues a recording command, the printer driver 96 of the computer 90 receives image information from the application program 95, and converts the image information to a signal (here, a multi-valued signal with respect to respective colors of cyan, magenta, yellow, and black) which can be processed by the ink jet printer 190. In this example, inside the printer driver 96, a resolution conversion module 97, color correction module 98, color correction table LUT, halftone module 99, and rasterizer 94 are disposed.

The resolution conversion module 97 plays a role of converting color image data resolution handled by the application program 95, that is, the number of pixels per unit length into a resolution which can be handled by the printer driver 96. Since the image data of which resolution is converted is image information constituted of three colors RGB, the color correction module 98 refers to the color correction table LUT to perform conversion to data of respective colors of cyan (C), magenta (M), yellow (Y), and black (BK) that the ink jet printer 100 uses for each pixel. The data that the color is corrected in this manner has a gradation value, for example, of 256 gradations or the like.

The halftone module 99 scatters dots, and executes a halftone processing to express a predetermined gradation value by the ink jet printer 100. The image data processed in this manner is rearranged in order of data to be transferred to the ink jet printer 100 by the rasterizer 94, and final image data FNL (recording information) is generated.

In the present embodiment, the ink jet printer 100 only plays a role of forming the dots in accordance with the image data FNL, and performs no image processing. Moreover, the printer driver 96 on the side of the computer 90 performs no adjustment of a drive signal inside the ink jet printer 100, but setting of a plurality of pulse signals included in the drive signal can be performed on the side of the printer driver 96 utilizing a bidirectional communication function with the ink jet printer 100.

Entire Constitution of Ink Jet Printer

Figure 3:
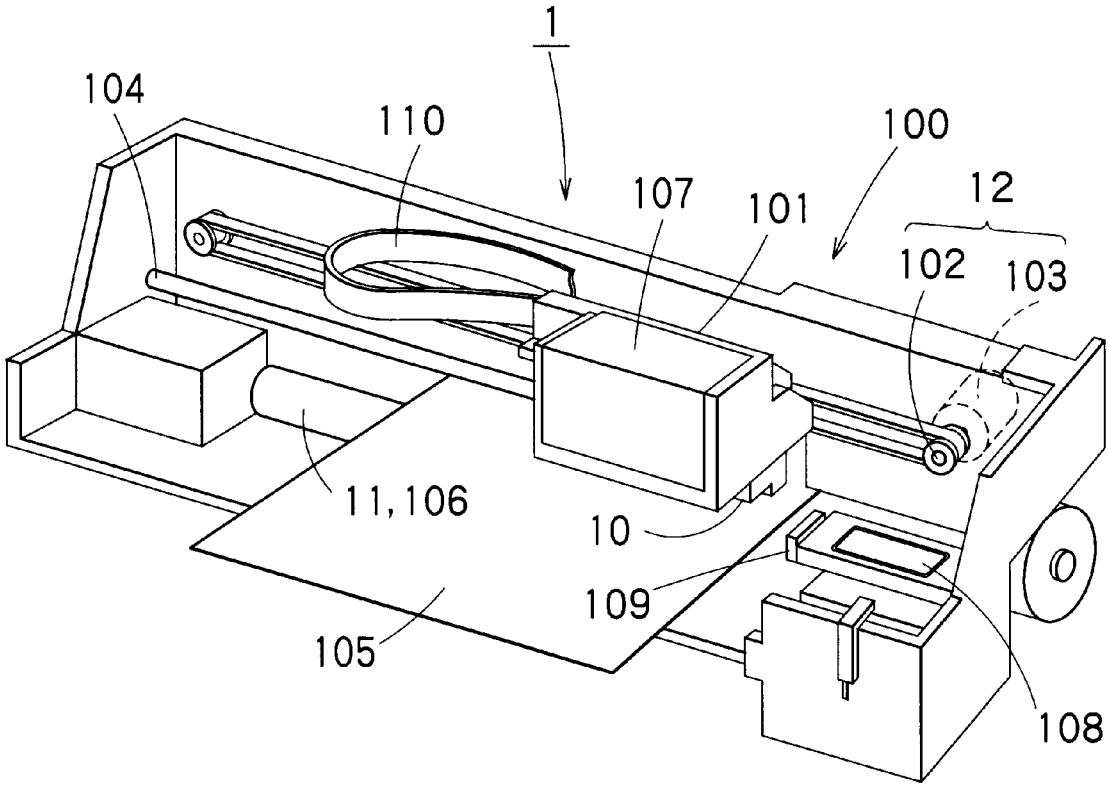
FIG. 3 is a perspective view showing a main part of an ink jet printer used in the ink jet recording apparatus shown in FIG. 1.

FIG. 3 is a perspective view showing a main part of the ink jet printer. As shown in FIG. 3, a carriage 101 of the ink jet printer 100 is connected to a carriage motor 103 of a carriage mechanism 12 via a timing belt 102. The carriage 101 is guided by a guide member 104 to reciprocate in a sheet width direction of a recording sheet 105.

The ink jet printer 100 is provided with a sheet feed mechanism 11 using a sheet feed roller 106. In the carriage 101, a recording head 10 of an ink jet system is attached to a surface opposite to the recording sheet 105, that is, an under surface in an example shown in FIG. 3.

The recording head 10 is replenished with ink from an ink cartridge 107 disposed on the top part of the carriage 101 to discharge ink droplets and form dots onto the recording sheet 105 with movement of the carriage 101, and records images or characters on the recording sheet 105.

As the ink cartridge 107, a black (BK) ink cartridge, and color cartridges of cyan (C), magenta (M), and yellow (Y) are mounted, but only one of these cartridges is shown.

Here, FIG. 3 shows a cut recording sheet, but the ink jet printer 100 of the present embodiment is provided with supply ports (not shown) via which respective recording sheets are supplied, so that both a cut recording sheet and a rolled sheet (continuous sheet) can be used.

Additionally, in a non-recording area of the ink jet printer 100, a capping device 108 is disposed to close a nozzle opening of the recording head 10 while the recording halts. Therefore, during the halt of recording, when solvent flies from the ink, ink viscosity increase or ink film formation can be inhibited, so that clogging can be prevented from occurring with a nozzle during the halt of recording.

Moreover, the capping device 108 receives the ink droplets from the recording head 10 by a flushing operation performed during a recording operation. A wiping device 109 is disposed in the vicinity of the capping device 108, and this wiping device 109 is constituted to wipe off attached ink residue or paper powder by wiping the surface of the recording head 10 with a blade.

Constitution of Printer Control System

Figure 4:
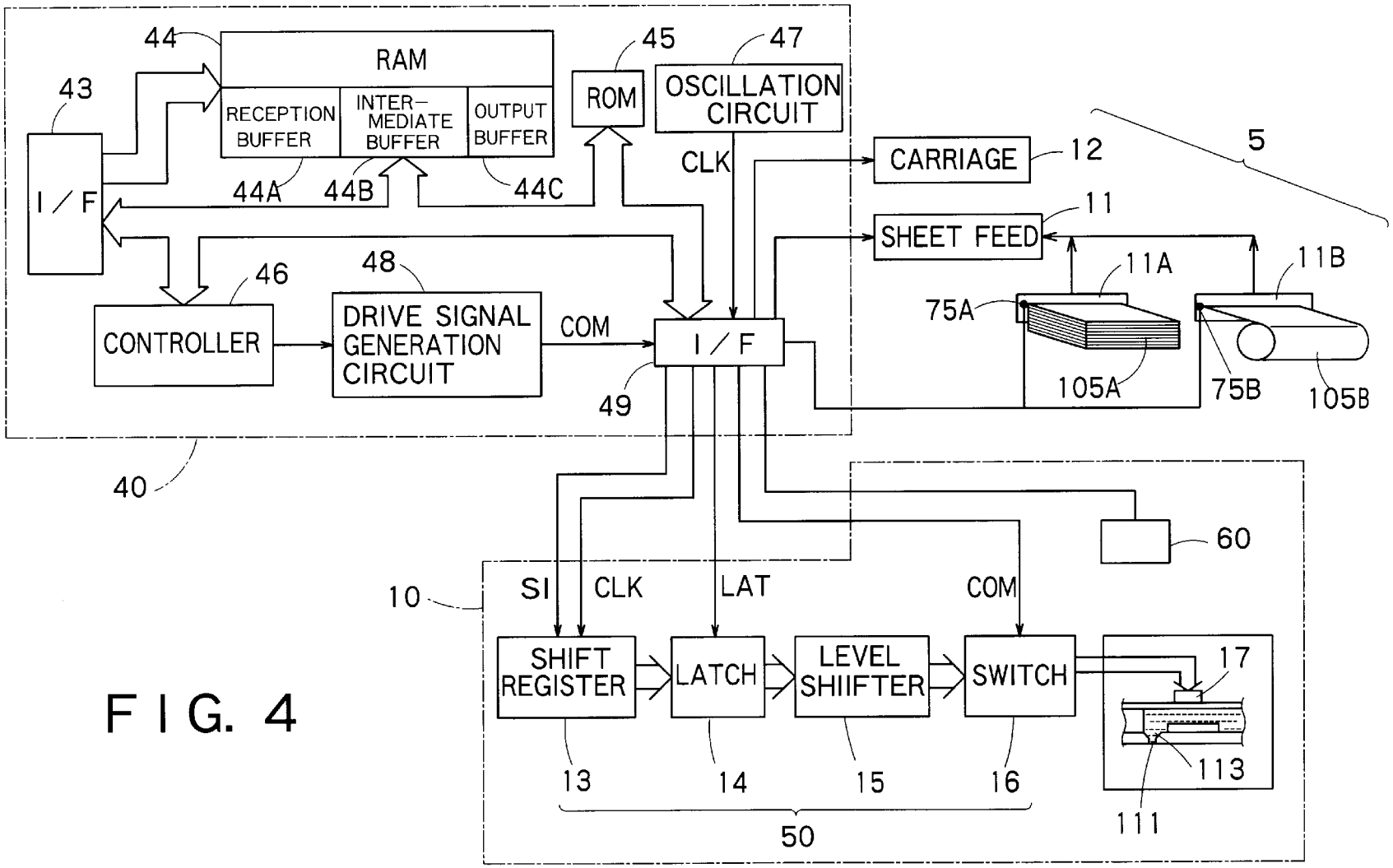
FIG. 4 is a function block diagram of the ink jet printer shown in FIG. 3.

FIG. 4 is a function block diagram of the ink jet printer 100 of the present embodiment. In FIG. 4, the ink jet printer 100 includes a print controller 40 and a print engine 5. The print controller 40 is provided with an interface 43 for receiving the image data FNL (recording information) including multi-valued gradation information from the computer 90 (see FIGS. 1, 2) and the like, a reception buffer 44A constituted of DRAM for storing various data such as the recording information including the multi-valued gradation information, an intermediate buffer 44B, an output buffer 44C constituted of SRAM, a ROM 45 for storing a routine for performing various data processings, a controller 46 constituted of CPU and the like, an oscillation circuit 47, a drive signal generation circuit 48 for generating a drive signal COM to the recording head 10, and an interface 49 for transmitting recording data SI developed in dot pattern data and drive signal COM to the print engine 5.

Constitution of Recording Head 10

The print engine 5 includes the recording head 10, sheet feed mechanism 11, and carriage mechanism 12. The sheet feed mechanism 11 successively feeds a recording sheet 105A such as an A4 cut sheet supplied from a cut sheet supply port 11A, or a continuous sheet 105B such as a rolled sheet supplied from a continuous sheet supply port 11B in order to scan in sub-scanning direction. The carriage mechanism 12 allows the recording head 10 to scan in main-scanning direction.

The recording head 10 discharges the ink droplets via respective nozzle openings 111 at a predetermined timing. The recording head 10 is provided with a head drive circuit 50 including a shift register 13, latch circuit 14, level shifter 15, and switch circuit 16.

In the head drive circuit 50, the recording data SI developed in the dot pattern data by the print controller 40 is transferred to the head drive circuit 50 of the recording head 10 via an interface 49 in synchronization with a clock signal CLK from the oscillation circuit 47.

When the recording data for all nozzles is set to respective elements of the shift register 13, the controller 46 outputs a latch signal LAT to the latch circuit 14 at a predetermined timing. By this latch signal, the latch circuit 14 latches nozzle selection data set to the shift register 13. The nozzle selection data latched by the latch circuit 14 is applied to the level shifter 15 acting as a voltage converter.

When the recording data SI indicates, for example, "1" the level shifter 15 converts the data SI into a voltage value which can be driven by the switch circuit 16, for example, several tens of volts. The converted recording data SI is applied to respective switching elements of the switch circuit 16, and the respective elements are placed in connection state.

Here, the drive signal COM generated by the drive signal generation circuit 48 is applied to each switching element of the switch circuit 16. When each switching element of the switch circuit 16 is placed in the connection state, the drive signal COM is applied to a pressure generation element 17 connected to the switching element. The recording head 10 can control whether or not the drive signal COM is applied to the pressure generation element 17 in accordance with the nozzle selection data corresponding to the recording data SI.

For example, while the nozzle selection data (recording data SI) indicates "1", the element of the switch circuit 16 is in the connection state, the drive signal COM can be supplied to the pressure generation element 17, and the pressure generation element 17 is displaced (deformed) by the supplied drive signal COM. Moreover, while the recording data SI indicates "0" the element of the switch circuit 16 is in a non-connection state, and supply of the drive signal COM to the pressure generation element 17 is interrupted. Additionally, while the nozzle selection data (recording data SI) indicates "0", each pressure generation element 17 holds a just previous charge, and a just previous displacement state is therefore maintained.

As described above, when the element of the switch circuit 16 is turned on and the drive signal COM is applied to the pressure generation element 17, a pressure generation chamber 113 connected to the nozzle opening 111 contracts, and ink in the pressure generation chamber 113 is pressurized. In this case, the ink in the pressure generation chamber 113 is discharged as the ink droplets from the nozzle opening 111, and the dots are formed on recording mediums such as the recording sheet.

Constitution of Drive Signal Generation Circuit 48

Figure 5:
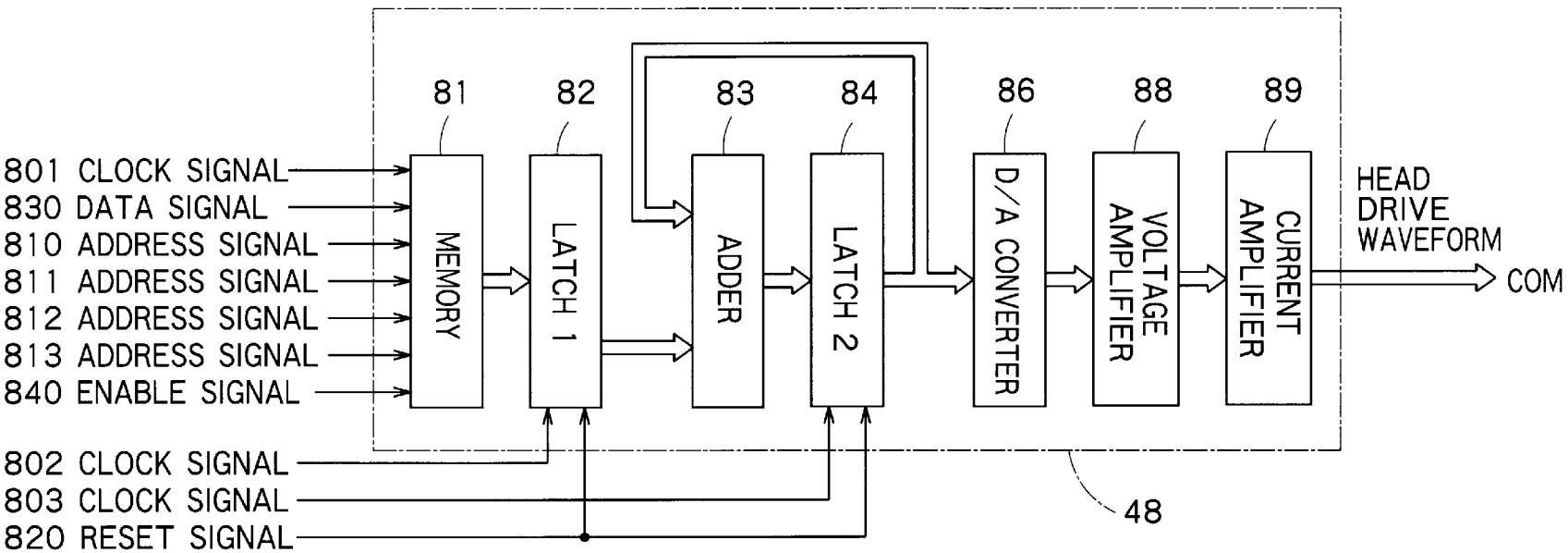
FIG. 5 is a block diagram of a drive signal generation circuit formed in the ink jet recording apparatus shown in FIG. 1.
Figure 6:
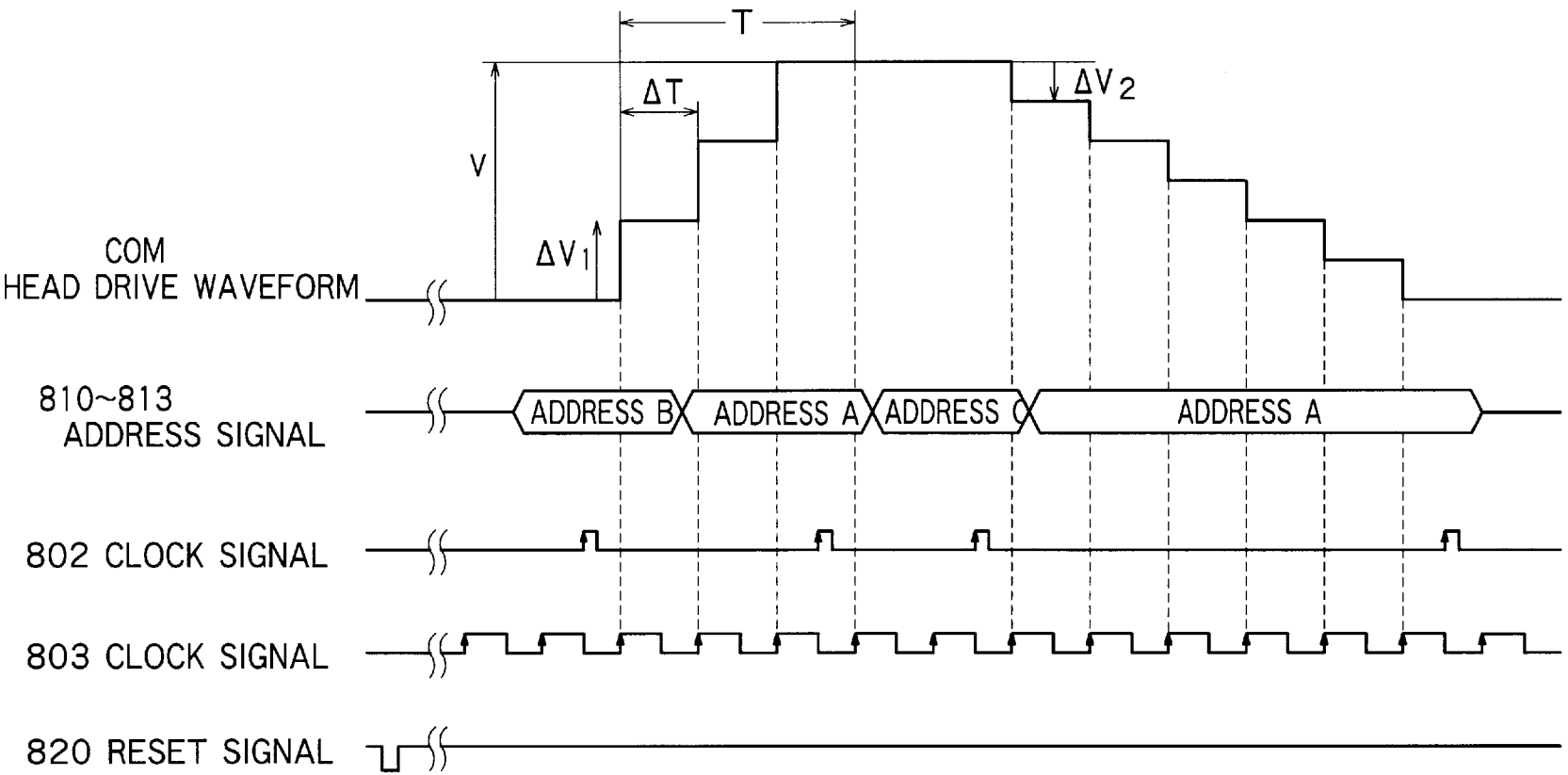
FIG. 6 is an explanatory view showing a process of generating each pulse included in a drive signal in the drive signal generation circuit shown in FIG. 5.
Figure 7:
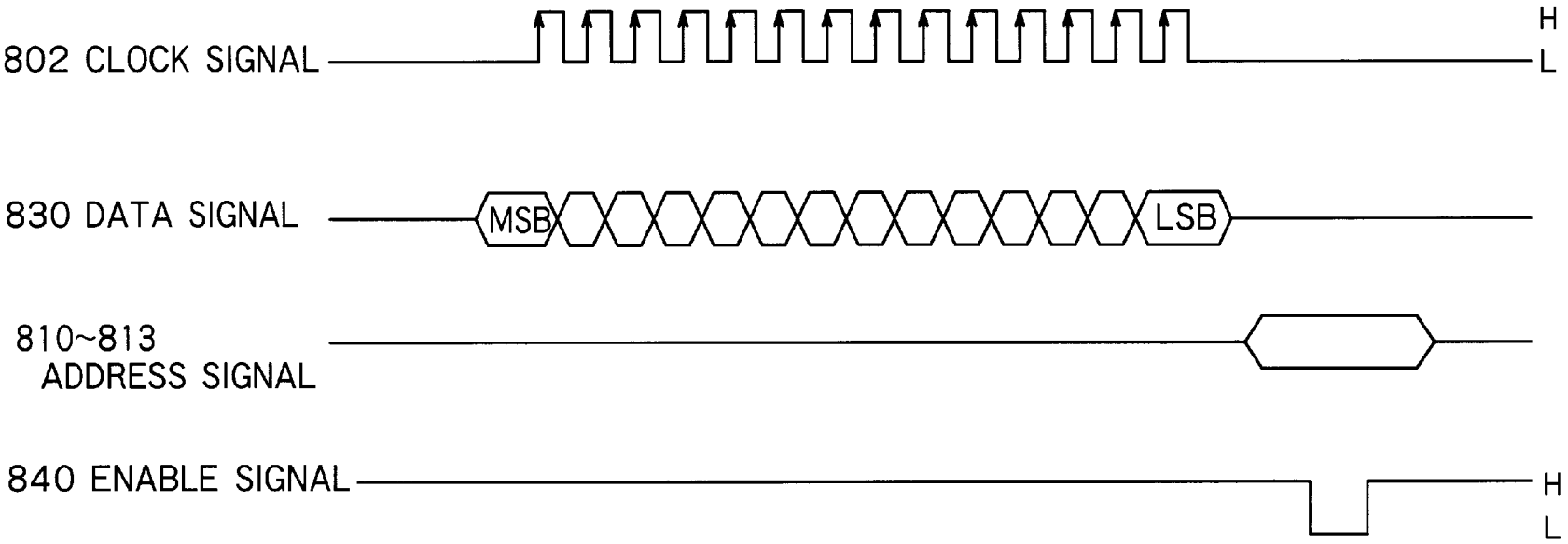
FIG. 7 is a timing chart showing each signal timing when a through rate is set in a memory based on a data signal in the drive signal generation circuit shown in FIG. 5.

FIG. 5 is a block diagram showing a configuration of the drive signal generation circuit 48. FIG. 6 is an explanatory view showing a process of generating each drive pulse included in the drive signal COM in the drive signal generation circuit 48. FIG. 7 is a timing chart showing each signal timing when a data signal is used to set a potential difference ΔV in a memory in the drive signal generation circuit 48.

In FIG. 5, the drive signal generation circuit 48 includes a memory 81 for receiving and recording a signal from the controller 46, a first latch 82 for reading and temporarily holding a content of the memory 81, an adder 83 for adding an output of the first latch 82 to an output of a second latch 84 described later, an A/D converter 86 for converting the output of the second latch 84 to an analog signal, a voltage amplifier 88 for amplifying the converted analog signal so as to provide a drive signal voltage, and a current amplifier 89 for generating a current corresponding to the drive signal outputted from the voltage amplifier 88. Here, the memory 81 is a waveform data storage unit for storing a predetermined parameter to define a waveform of the drive signal COM.

The waveform of the drive signal COM is determined by the predetermined parameter received beforehand from the controller 46. That is, the drive signal generation circuit 48 receives clock signals 801, 802, 803, a data signal 830, address signals 810, 811, 812, 813, a reset signal 820 and an enable signal 840.

In the drive signal generation circuit 48 constituted as described above, as shown in FIG. 6, prior to generation of the drive signal COM, some data signals indicating a voltage change amount of the controller 46, and addresses of the data signals are stored in the memory 81 in synchronization with the clock signal 801.

The data signal 830 is sent and received, as shown in FIG. 7, by serial transfer in which the clock signal 801 is used as a synchronous signal. That is, when a predetermined voltage change amount is transferred from the controller 46, first the data signal of a plurality of bits is outputted in synchronization with the clock signal 801, and the address for storing the data is then outputted as the address signals 810 to 813 in synchronization with the enable signal 840.

The memory 81 reads the address signal at a timing at which this enable signal 840 is outputted, and writes the received data to the address. Each of the address signals 810 to 813 is a four bit signal, and 16 types of voltage change amounts at maximum can be stored in the memory 81. Additionally, the uppermost bit of the data is used as a code.

After setting of the voltage change amount to respective addresses A, B, . . . is completed, the address B is outputted to the address signals 810 to 813, and by the first clock signal 802, the voltage change amount corresponding to the address B is then held in the first latch circuit 82. When the next clock signal 803 is outputted in this state, the value obtained by adding the output of the first latch circuit 82 to the output of the second latch circuit 84 is held in the second latch circuit 84.

That is, as shown in FIG. 6, after the voltage change amount corresponding to the address signal is once selected, by each time receiving every clock signal 803, the output of the second latch circuit 84 increases/decreases in accordance with the voltage change amount. A through rate of the drive waveform is determined by a voltage change amount ΔV1 stored in the address B of the memory 81 and unit time ΔT of the clock signal 803. Additionally, increase or decrease is determined by the code of the data stored in each address.

In an example shown in FIG. 6, a value 0 as the voltage change amount, that is, a value for maintaining the voltage is stored in the address A. Therefore, when the address A becomes valid by the clock signal 802, the waveform of the drive signal is kept in a flat statewithout any increase/decrease. Moreover, to determine the through rate of the drive waveform, a voltage change amount ΔV2 per unit time ΔT is stored in the address C. Therefore, after the address C becomes valid by the clock signal 802, the voltage drops by the voltage ΔV2.

As described above, simply by outputting the address and clock signals from the controller 46, the waveform of the drive signal COM can freely be controlled. An example is shown in FIG. 8.

Figure 8:
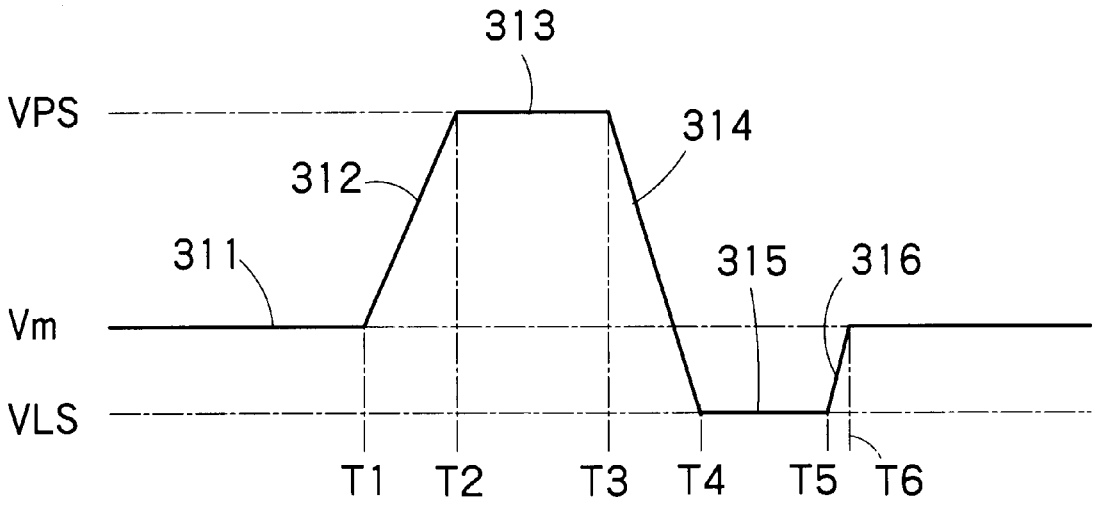
FIG. 8 is a waveform diagram showing one example of the drive signal used in the ink jet recording apparatus shown in FIG. 1.

A drive waveform COM shown in FIG. 8 starts from an intermediate potential Vm (hold pulse 311), rises with a constant inclination to a maximum potential VPS from time T1 till time T2 (charge pulse 312), and maintains the maximum potential VPS from time T2 till time T3 (hold pulse 313). Subsequently, after the waveform drops with a constant inclination to a minimum potential VLS from time T3 till time T4 (discharge pulse 314), a minimum potential VLS is maintained from time T4 till time T5 (hold pulse 315). Subsequently, the voltage value rises with a constant inclination to the intermediate potential Vm from time T5 till time T6 (charge pulse 316).

Therefore, when the charge pulse 312 is applied to the pressure generation element 17 shown in FIG. 4, the pressure generation element 17 is deflected to expand a volume of the pressure generation chamber 113, and generates a negative pressure in the pressure generation chamber 113. As a result, a meniscus is retracted from the nozzle opening 111. Subsequently, when the discharge pulse 314 is applied, the pressure generation element 17 is deflected to contract the volume of the pressure generation chamber 113, and a positive pressure is generated in the pressure generation chamber 113. As a result, the ink droplets are discharged from the nozzle opening 111. Subsequently, after the hold pulse 315 is applied, the charge pulse 316 is applied so that the meniscus does not vibrate.

First Concrete Embodiment of Temperature Correction

Figure 9:
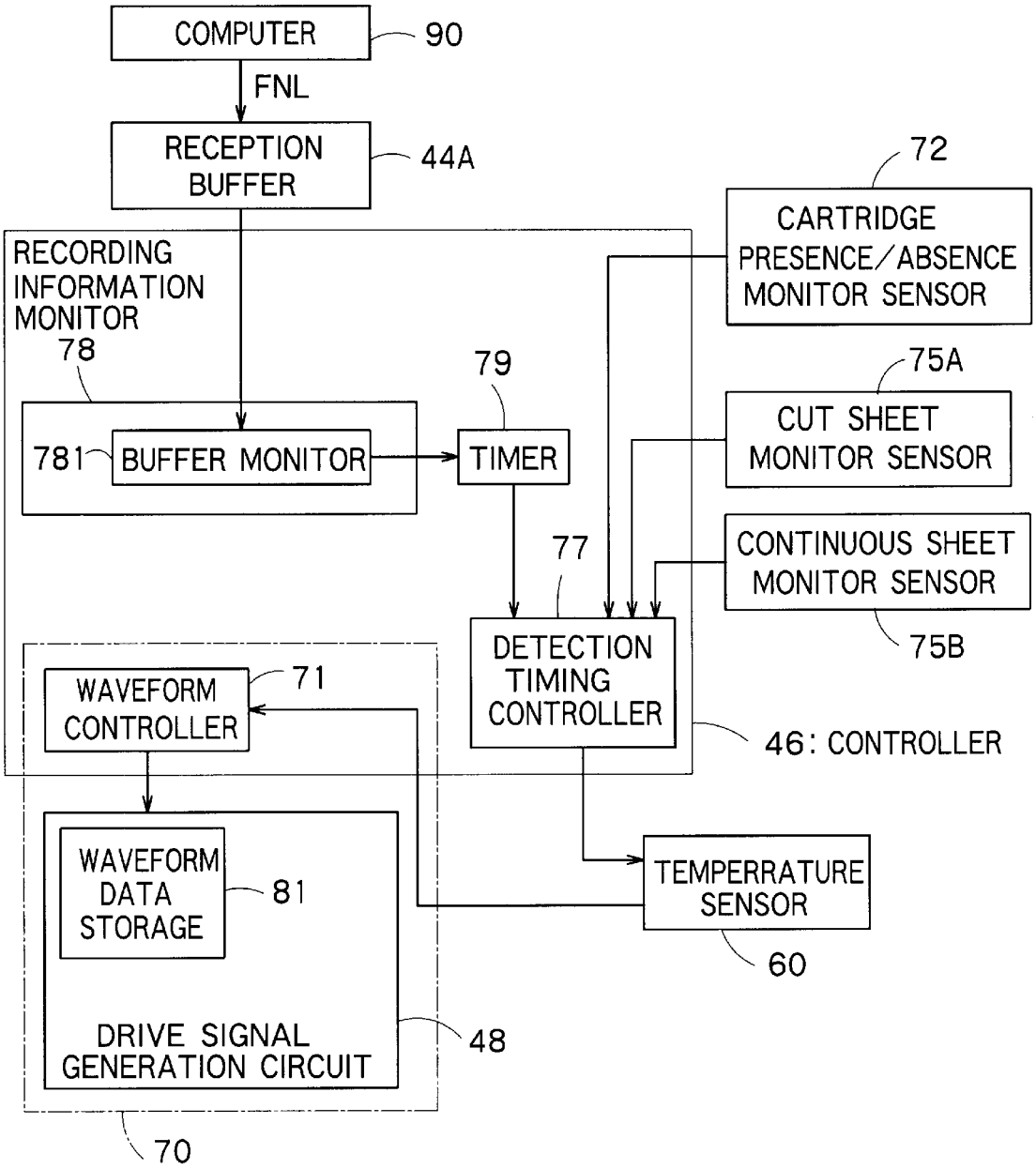
FIG. 9 is a block diagram showing a configuration for performing a temperature correction on ink droplet discharge conditions in the ink jet recording apparatus shown in FIG. 1.

FIG. 9 is a block diagram showing a configuration for performing temperature correction for ink droplet discharge conditions in the ink jet recording apparatus shown in FIG. 1.

In the ink jet recording apparatus 1, when discharging of the ink droplets is repeatedly performed, the recording head 10 causes a temperature rise, and the ink viscosity changes.

As a result, an ink discharge amount fluctuates, and a recording quality is deteriorated. Therefore, as shown in FIGS. 4 and 9, a temperature sensor 60 for detecting a temperature of the recording head 10 every constant time is disposed. The detection result of the temperature sensor 60 is inputted to a temperature corrector 70 of the controller 46.

The temperature corrector 70 changes the waveform and voltage value of the drive waveform COM based on the temperature of the recording head 10 detected by the temperature sensor 60. Specifically, a waveform controller 71 in the temperature corrector 70 controls the drive signal generation circuit 48 on the basis of the temperature detection result of the temperature sensor 60.

Specifically, the waveform controller 71 controls the drive signal generation circuit 48 so that a constant amount of ink droplets are discharged even with the rise of the temperature (ink temperature) of the recording head 10, performs corrections such as narrowing of amplitude of the drive signal COM shown in FIG. 8 and sets a target weight of ink droplets to be slightly light. Moreover, as described hereinafter, when the temperature of the recording head 10 drops, the ink viscosity is high. Therefore, the waveform controller 71 controls the drive signal generation circuit 48 so that the constant amount of ink droplets is discharged even when the temperature of the recording head 10 (ink temperature) drops. In this case, the waveform controller 71 performs corrections of expanding the amplitude of the drive signal COM shown in FIG. 8 and the like, thereby setting the target weight of ink droplets to be slightly heavy.

In order to perform the temperature correction in consideration of even the temperature drop at an adequate timing, the cut sheet supply port 11A shown in FIGS. 4 and 9 is provided with a cut sheet detection sensor 75A (medium shortage monitor means/discontinuance monitor means, recording stop monitor means) for monitoring whether the cut sheet 105A is present or not, and the continuous sheet supply port 11B is provided with a continuous sheet detection sensor 75B (medium shortage monitor means/discontinuance monitor means, recording stop monitor means) for monitoring whether the continuous sheet 105B is present or not. The detection results of these sensors 75A and 75B are inputted to a detection timing controller 77 of the controller 46.

Here, the detection timing controller 77 controls a timing for detecting the temperature of the recording head 10 with respect to the temperature sensor 60. On the basis of the monitor result of the cut sheet detection sensor 75A or the continuous sheet detection sensor 75B, when the used recording sheet, that is, the cut sheet or the continuous sheet comes short, the discharging of ink droplets is discontinued for a while. Since the temperature of the recording head 10 (ink temperature) possibly drops during the discontinuance, the temperature sensor 60 detects the temperature of the recording head 10. Therefore, when the temperature of the recording head 10 drops, the temperature corrector 70 allows the waveform controller 71 to perform the corrections of expanding the amplitude of the drive signal COM shown in FIG. 8 and the like, thereby setting the target weight of ink droplets to be slightly heavy.

Moreover, as shown in FIG. 9, the controller 46 of the present embodiment has a recording information monitor 78 and a timer 79 as means for monitoring the discontinuance of discharging of ink droplets (discontinuance monitor means, recording stop monitor means).

The recording information monitor 78 monitors whether or not the image data FNL is inputted to the ink jet printer 100 from the computer 90 described with reference to FIGS. 1 and 2, and measures the elapse of time from the discontinuance with the timer 79 when inputting of the image data FNL is discontinued.

Therefore, according to the measurement result of the timer 79, when the inputting of the image data FNL is discontinued and a predetermined time elapses, the detection timing controller 77 judges that the discharging of ink droplets is discontinued for the predetermined time and the temperature of the recording head 10 (ink temperature) possibly drops, and allows the temperature sensor 60 to detect the temperature of the recording head 10.

Therefore, when the temperature sensor 60 detects that the temperature of the recording head 10 drops, the temperature corrector 70 allows the waveform controller 71 to perform the corrections of expanding the amplitude of the drive signal COM shown in FIG. 8 and the like, thereby setting the target weight of ink droplets to be slightly heavy.

As described above, for a purpose of monitoring whether the recording operation is stopped or not, the recording information monitor 78 of the present embodiment has a buffer monitor 781 to monitor whether or not there is reception data in the reception buffer 44A.

Since the recording information FNL from the computer 90 is first inputted to the reception buffer 44A, no recording operation is performed as long as there is no data in the reception buffer 44A. Therefore, when there is reception data in the reception buffer 44A, the buffer monitor 781 can judge that the recording operation is being performed. When there is no reception data in the reception buffer 44A, it can be judged that the recording operation is stopped.

Furthermore, in the present embodiment, a cartridge presence/absence monitor sensor 72 (change monitor means of cartridge 107/discontinuance monitor means, recording stop monitor means) for monitoring an attachment state of the ink cartridge 107 is disposed. The detection result of the cartridge presence/absence monitor sensor 72 is inputted to the detection timing controller 77 of the controller 46. Therefore, for the detection timing controller 77, on the basis of the monitor result of the cartridge presence/absence monitor sensor 72, when judged that the cartridge 107 is removed, it is judged that the discharging of ink droplets is discontinued for the predetermined time and that the temperature of the recording head 10 (ink temperature) possibly drops, and the temperature sensor 60 detects the temperature of the recording head 10.

On the basis of the monitor result of the temperature sensor 60, when the temperature of the recording head 10 drops, the temperature corrector 70 allows the waveform controller 71 to perform the corrections of expanding the amplitude of the drive signal COM shown in FIG. 8 and the like, thereby setting the target eight of ink droplets to be slightly heavy.

As described above, when the discharging of ink droplets is discontinued, the temperature of the recording head 10 drops and the ink viscosity rises. Therefore, when the ink droplets are discharged on the same conditions as before, the weight of ink droplets becomes too light. Therefore, it is monitored that the discharging operation of ink droplets is discontinued. On the basis of the monitor result, when the discharging operation of ink droplets is discontinued, the temperature detection of the recording head is performed.

As described above, in the ink jet recording apparatus 1 of the present embodiment, when the discharging of ink droplets is discontinued, the temperature of the recording head 10 is detected and the temperature correction is performed. Therefore, even when the discontinuance of discharging of ink droplets results in the temperature drop of the recording head 10 and the rise of the ink viscosity, the ink droplet discharge conditions are corrected in order to absorb the viscosity change. Therefore, the fluctuation of the weight of ink droplets is prevented, thereby performing a high quality recording. Moreover, in the present embodiment, since the temperature correction is performed during the stop period of discharging of ink droplets, there is an advantage that recording throughput is not deteriorated.

Second Concrete Embodiment of Temperature Correction

A second concrete example sets a temperature correction time, by judging whether or not data exists in the buffer for temporarily storing recording information from the outside, a temperature correction timing is set.

Figure 10:
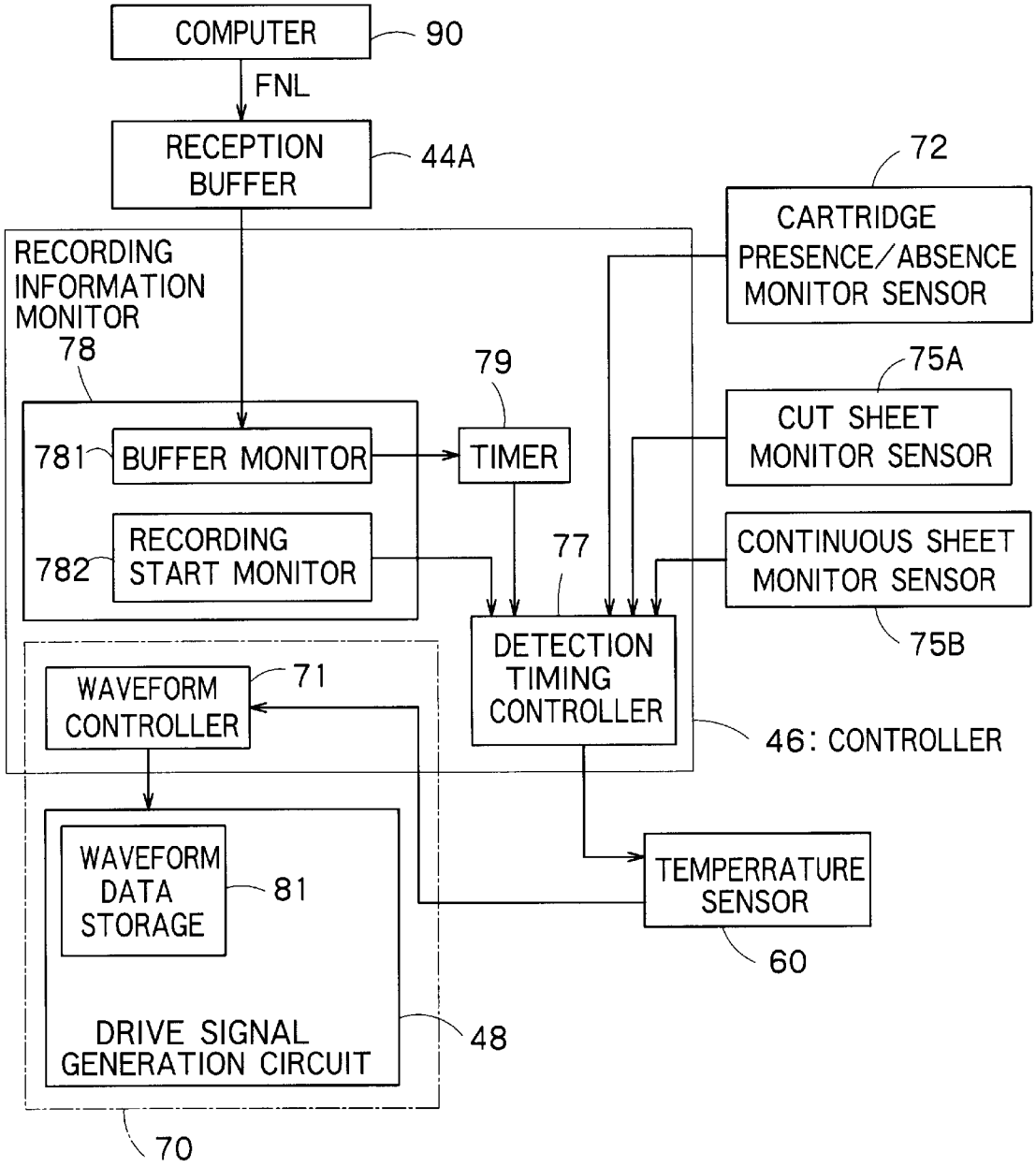
FIG. 10 is a block diagram showing a configuration for performing temperature correction for the ink droplet discharge conditions in another ink jet recording apparatus to which the present invention is applied.

FIG. 10 is a block diagram showing a configuration for performing the temperature correction for ink droplet discharge conditions in another ink jet recording apparatus to which the present invention is applied. In FIG. 10, constituting parts common to FIG. 9 are denoted with the same reference numerals, and different respects will mainly be described hereinafter.

The recording information monitor 78 of FIG. 10 further comprises a recording start monitor 782 (recording start monitor means). On the basis of the monitor result of the buffer monitor 781, when a state in which no reception data is in the reception buffer 44A changes to a state in which the reception data exists by inputting the recording information FNL from the computer for a predetermined period, the recording start monitor 782 judges that recording is to start and outputs a signal indicating this state to the detection timing controller 77.

Therefore, just before beginning recording operation after a state in which the recording operation is stopped or discontinued, the detection timing controller 77 necessarily allows the temperature sensor 60 to detect the temperature of the recording head 10. Therefore, on the basis of the monitor result of the temperature sensor 60, the temperature corrector 70 performs the correction for expanding the amplitude of the drive signal COM shown in FIG. 8 or narrowing the amplitude of the drive signal COM with respect to the drive signal generation circuit 48 in accordance with the temperature of the recording head 10 immediately before the recording start.

Therefore, in the ink jet recording apparatus 1 of the present embodiment, even when the recording operation is stopped or discontinued, the correct temperature correction can be performed in accordance with the temperature of the recording head 10 immediately before the discharging of ink droplets, so that it is possible to discharge the ink droplets with the predetermined weight steadily from the start.

Third Concrete Embodiment of Temperature Correction

A third concrete embodiment performs the recording head temperature correction by a predetermined raster number of a recording medium.

Figure 11:
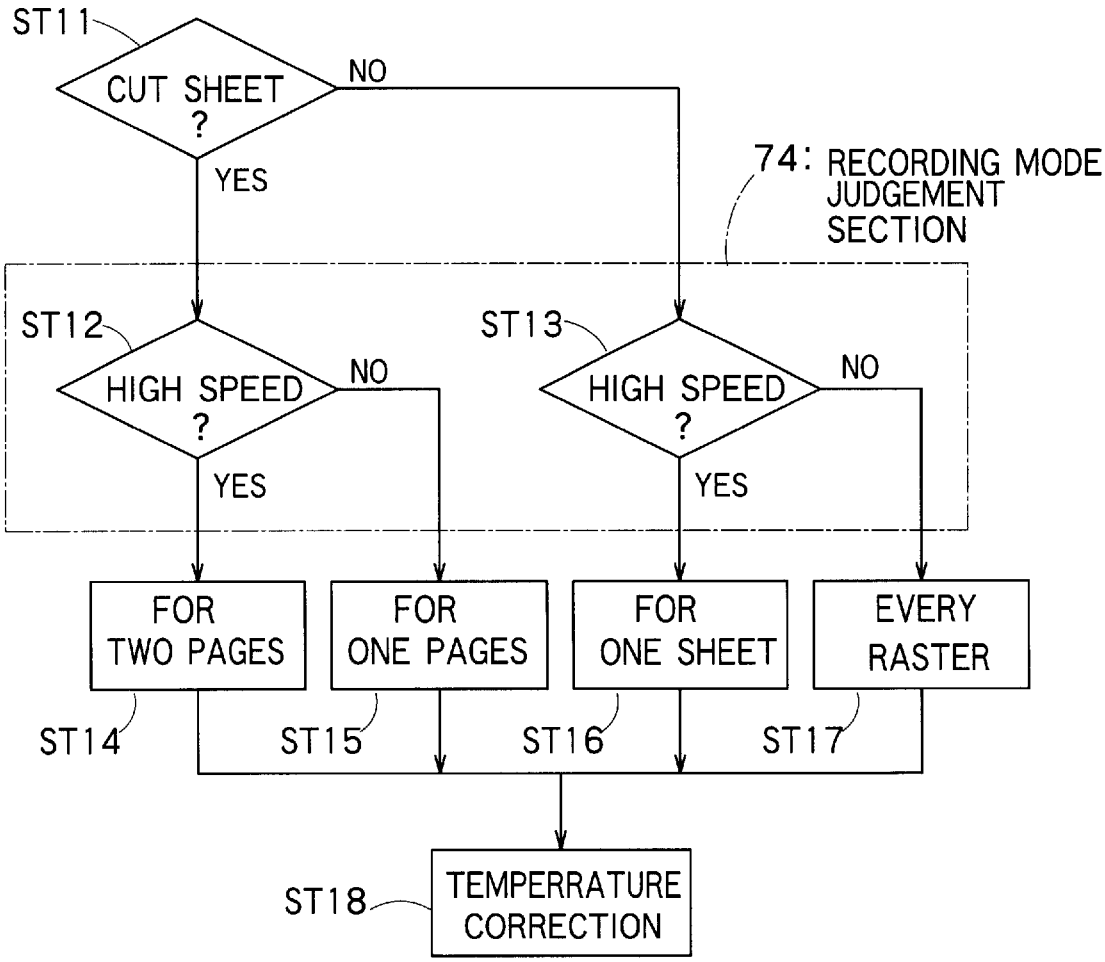
FIG. 11 is a flowchart showing an operation for performing the temperature correction for the ink droplet discharge conditions.

FIG. 11 is a flowchart showing a temperature correction operation carried out in the ink jet printer 100 of the present embodiment. Additionally, the operation performed here is based on the program stored beforehand in the ROM 45.

First, the detection timing controller 77 shown in FIG. 10 judges whether the recording in this time is performed with respect to the cut sheet or the continuous sheet based on outputs from the cut sheet detection sensor 75A and continuous sheet detection sensor 75B (step ST11).

Subsequently, even when the present recording is performed with respect to either the cut sheet or the continuous sheet, on the basis of the judgment result in a recording mode judgment section 74, it is judged whether the present recording is performed in a high speed recording mode or a low speed highly fine mode (steps ST12, ST13).

Among these judgment processings, as a result of the judgment processing in the step ST12, when the recording is performed in a cut sheet and high speed mode, for example, the temperature sensor 60 performs temperature detection every time the recording for two pages is completed. On the basis of the temperature detection result, the temperature corrector 70 allows the waveform controller 71 to correct the waveform or the voltage of the drive signal COM.

Moreover, as a result of the judgment processing in the step ST12, when the recording is performed in a cut sheet and highly fine mode, for example, the temperature sensor 60 performs temperature detection every time the recording for one page is completed. On the basis of the temperature detection result, the temperature corrector 70 allows the waveform controller 71 to correct the waveform or the voltage of the drive signal COM.

Furthermore, as a result of the judgment processing of the step ST13, when the recording is performed in a continuous sheet and high speed mode, for example, the temperature sensor 60 performs temperature detection every time the recording for the raster corresponding to one sheet obtained by cutting a continuous paper is completed. On the basis of the temperature detection result, the temperature corrector 70 allows the waveform controller 71 to correct the waveform or the voltage of the drive signal COM.

On the other hand, as a result of the judgment processing of the step ST13, when the recording is performed with the continuous sheet 105B in a highly fine mode, for example, the temperature sensor 60 performs the temperature detection every time the recording for every raster is completed. On the basis of the temperature detection result, the temperature corrector 70 allows the waveform controller 71 to correct the waveform or the voltage of the drive signal COM.

As described above, the detection timing controller 77 of the present embodiment does not perform the temperature correction by allowing the temperature sensor 60 to perform the temperature detection simply with the elapse of time, but instead allows the temperature sensor 60 to perform the temperature detection in accordance with a timing for completing the recording operation for the predetermined raster number.

For example, when the recording is performed on the A4 cut sheet, time for completing one page of recording and feeding the sheet is necessarily utilized to allow the temperature sensor 60 to perform the temperature detection of the recording head 10. In the recording on the continuous sheet, necessarily after the processing of the predetermined raster number is completed, the temperature sensor 60 performs the temperature detection of the recording head 10. Specifically, in the present embodiment, by avoiding a timing for performing the recording operation or data transfer, the temperature sensor 60 performs the temperature detection. Therefore, a situation in which a processing for temperature correction overlaps another print operation can be avoided.

Moreover, on the basis of the judgment result by medium type judgment means constituted of the cut sheet detection sensor 75A and continuous sheet detection sensor 75B, the detection timing controller 77 allows the temperature sensor 60 to perform the temperature detection of the recording head 10 by each page when the recording medium is the cut sheet, and allows the temperature sensor 60 to perform the temperature detection of the recording head 10 by a predetermined raster unit when the recording medium is the continuous sheet.

When the recording is performed on the cut sheets such as the A4 sheet, the time for completing one page of recording and feeding the sheet is utilized to allow the temperature sensor 60 to perform the temperature detection. Thereby, in the recording on the cut sheet, the operation is performed in preference to the recording throughput, and in the recording on the continuous sheet, the recording quality is improved by frequently performing the temperature correction, so that the recording operation can be performed in accordance with the type of the recording medium.

Moreover, the detection timing controller 77 of the present embodiment compares the high speed recording mode with the highly fine mode on the basis of the judgment result by the recording mode judgment section 74, and allows the temperature sensor 60 to perform the temperature detection of the recording head 10 at a long interval. Therefore, in the high speed recording mode, the operation is performed in preference to the recording throughput, and in the highly fine mode, the recording quality is improved by frequently performing the temperature correction, so that the recording operation can be performed in accordance with the recording mode.

Fourth Concrete Embodiment of Temperature Correction

Figure 12:
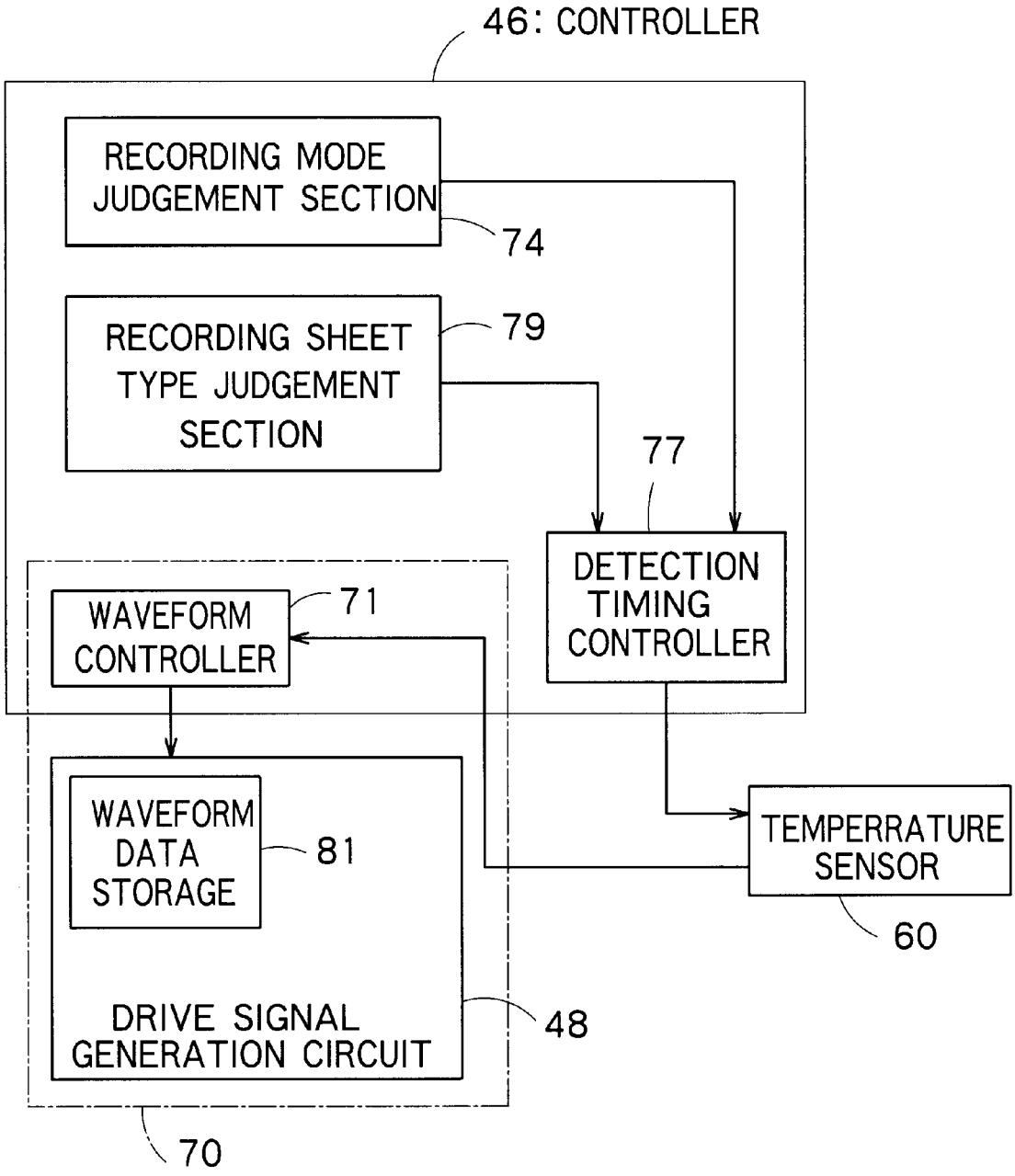
FIG. 12 is a block diagram showing a configuration for performing the temperature correction for the ink droplet discharge conditions.

The aforementioned embodiment is constituted that the cut sheet detection sensor 75A and continuous sheet detection sensor 75B disposed in two recording sheet supply ports of the cut sheet supply port 11A and continuous sheet supply port 11B, respectively, detect whether the recording medium is the cut sheet or the continuous sheet. However, for example, as shown in FIGS. 12, a recording sheet judgment section 79 may be disposed on the controller 46 to judge, for example, whether the present recording mode is the cut sheet 105A or the continuous sheet 105B based on recording condition setting data set from the data driver 96 of the computer 90 (see FIGS. 1 and 2). Since other configurations are similar to the configurations of the aforementioned embodiment, parts provided with common functions are denoted with the same reference numerals in FIG. 12 and the description thereof is omitted.

Even in the ink jet recording apparatus 1 constituted as described above, the operation of the temperature correction is as shown in FIG. 11 except that the sheet type is judged on software, and the description thereof is therefore omitted. The detection timing controller 77 does not perform the temperature correction by allowing the temperature sensor 60 to perform the temperature detection simply with the elapse of time. In the recording on the A4 cut sheet 105A, the time for completing one page of recording and feeding the sheet is necessarily utilized to allow the temperature sensor 60 to perform the temperature detection of the recording head 10. In the recording on the continuous sheet 105B, the temperature sensor 60 necessarily performs the temperature detection of the recording head 10 by every predetermined raster number. Therefore, the temperature sensor 60 can perform the temperature detection necessarily avoiding the time for performing the recording operation or the data transfer, and other effects similar to those of the aforementioned embodiment can be obtained.

In the aforementioned embodiments, the ink jet recording apparatus using the piezoelectric vibrator as the pressure generation element has been described, but the present invention can be also applied to an ink jet recording apparatus in which pressure is generated in the pressure generation chamber by heat, and the like.

What is claimed is:

1. An ink jet recording apparatus comprising:

a recording head in which when a plurality of pressure generation elements corresponding to a plurality of nozzle openings, respectively, pressurize ink in a pressure generation chamber connected to said nozzle openings, ink droplets are discharged to a recording medium through said nozzle openings;

temperature detection means for detecting a temperature of said recording head;

detection timing control means for allowing said temperature detection means to detect the temperature of said recording head at a predetermined timing;

drive signal generation means for generating a drive signal for driving said recording head;

temperature correction means for adjusting a drive waveform of said drive signal based on the detecting result of the temperature by said temperature detection means, so that the amount of the ink droplets becomes constant without dependence on the temperature; and recording stop monitor means for monitoring whether the discharging of the ink droplets is stopped or not, wherein on the basis of a monitor result of said recording stop monitor means, when the discharging of the ink droplets is stopped, said detection timing control means allows said temperature detection means to detect the temperature of said recording head until the discharging of the ink droplets starts.

2. The ink jet recording apparatus according to claim 1 wherein said recording stop monitor means include discontinuance monitor means for monitoring that a discharging operation of the ink droplets is temporarily discontinued, and judges whether the discharging of the ink droplets is stopped or not on the basis of a monitor result of the discontinuance monitor means.

3. The ink jet recording apparatus according to claim 1 wherein said recording stop monitor means include buffer monitor means for monitoring whether or not data exists in a buffer for temporarily storing recording information for indicating the discharging of the ink droplets, and judges that the discharging of the ink droplets is stopped when no data exists in said buffer, on the basis of a monitor result of the buffer monitor means.

4. The ink jet recording apparatus according to claim 1 wherein said recording stop monitor means include recording start monitor means for monitoring a timing of starting a discharging operation of the ink droplets, and on the basis of a monitor result of the recording stop monitor means and a monitor result of said recording start monitor means, said detection timing control means allows said temperature detection means to detect the temperature of said recording head immediately before the discharging operation of the ink droplets starts.

5. The ink jet recording apparatus according to claim 1 wherein said temperature correction means correct at least one of an amplitude and a drive waveform of a drive signal of said recording head on the basis of the temperature detection result of said recording head by said temperature detection means immediately before the ink droplets are discharged.

6. An ink jet recording apparatus comprising:

a recording head in which when a plurality of pressure generation elements corresponding to a plurality of nozzle openings, respectively, pressurize ink in a pressure generation chamber connected to said nozzle openings, ink droplets are discharged to a recording medium through said nozzle openings;

temperature detection means for detecting a temperature of said recording head;

detection timing control means for allowing said temperature detection means to detect the temperature of said recording head at a predetermined timing;

temperature correction means for adjusting a drive waveform of said drive signal based on the detecting result of the temperature by said temperature detection means, so that the amount of the ink droplets becomes constant without dependence on the temperature; and recording stop monitor means for monitoring whether the discharging of the ink droplets is stopped or not, wherein on the basis of a monitor result of said recording stop monitor means, when the discharging of the ink droplets is stopped, said detection timing control means allows said temperature detection means to detect the temperature of said recording head until the discharging of the ink droplets starts, said recording stop monitor means include discontinuance monitor means for monitoring that a discharging operation of the ink droplets is temporarily discontinued, and judges whether the discharging of the ink droplets is stopped or not on the basis of a monitor result of the discontinuance monitor means, said discontinuance monitor means include time measurement means for measuring a time which elapses after the discharging of the ink droplets stops, and on the basis of a time measurement result of the time measurement means, said detection timing control means allows said temperature detection means to detect the temperature of said recording head when the discharging of the ink droplets is discontinued for a predetermined time or more.

7. The ink jet recording apparatus according to claim 6 wherein said time measurement means judges that the discharging of the ink droplets stops when the input of recording information for indicating the discharging of the ink droplets stops, and measures a time which elapses after the input of the recording information stops.

8. An ink jet recording apparatus comprising:

a recording head in which when a plurality of pressure generation elements corresponding to a plurality of nozzle openings, respectively, pressurize ink in a pressure generation chamber connected to said nozzle openings, ink droplets are discharged to a recording medium through said nozzle openings;

temperature detection means for detecting a temperature of said recording head;

detection timing control means for allowing said temperature detection means to detect the temperature of said recording head at a predetermined timing;

temperature correction means for adjusting a drive waveform of said drive signal based on the detecting result of the temperature by said temperature detection means, so that the amount of the ink droplets becomes constant without dependence on the temperature; and recording stop monitor means for monitoring whether the discharging of the ink droplets is stopped or not, wherein on the basis of a monitor result of said recording stop monitor means, when the discharging of the ink droplets is stopped, said detection timing control means allows said temperature detection means to detect the temperature of said recording head until the discharging of the ink droplets starts, said recording stop monitor means include discontinuance monitor means for monitoring that a discharging operation of the ink droplets is temporarily discontinued, and judges whether the discharging of the ink droplets is stopped or not on the basis of a monitor result of the discontinuance monitor means, said discontinuance monitor means include replacement monitor means for monitoring that an ink container for supplying the ink to said pressure generation chamber is replaced, and on the basis of a monitor result of said replacement monitor means, said detection timing control means allows said temperature detection means to detect the temperature of said recording head when said ink container is performed.

9. An ink jet recording apparatus comprising:

a recording head in which when a plurality of pressure generation elements corresponding to a plurality of nozzle openings, respectively, pressurize ink in a pressure generation chamber connected to said nozzle openings, ink droplets are discharged to a recording medium through said nozzle openings;

temperature detection means for detecting a temperature of said recording head;

detection timing control means for allowing said temperature detection means to detect the temperature of said recording head at a predetermined timing;

temperature correction means for adjusting a drive waveform of said drive signal based on the detecting result of the temperature by said temperature detection means, so that the amount of the ink droplets becomes constant without dependence on the temperature; and recording stop monitor means for monitoring whether the discharging of the ink droplets is stopped or not, wherein on the basis of a monitor result of said recording stop monitor means, when the discharging of the ink droplets is stopped, said detection timing control means allows said temperature detection means to detect the temperature of said recording head until the discharging of the ink droplets starts, said recording stop monitor means include discontinuance monitor means for monitoring that a discharging operation of the ink droplets is temporarily discontinued, and judges whether the discharging of the ink droplets is stopped or not on the basis of a monitor result of the discontinuance monitor means, said discontinuance monitor means include medium shortage monitor means for monitoring that said recording medium to be recorded fails to exist, and on the basis of a monitor result of said medium shortage monitor means, said detection timing control means allows said temperature detection means to detect the temperature of said recording head when said recording medium fails to exist.

10. An ink jet recording method by a recording head in which when a plurality of pressure generation elements corresponding to a plurality of nozzle openings, respectively, pressurize ink in a pressure generation chamber connected to said nozzle openings, ink droplets are discharged to a recording medium through said nozzle openings, said ink jet recording method comprising:

detecting a temperature of said recording head at a predetermined timing;

generating a drive signal for driving said recording head;

adjusting a drive waveform of said drive signal based on the detecting result of the temperature, so that the amount of the ink droplets becomes constant without dependence on the temperature; and monitoring whether the discharging of the ink droplets is stopped or not, wherein on the basis of a monitor result of said monitoring operation, when the discharging of the ink droplets is stopped, the temperature of said recording head is detected during said detecting operation until the discharging of the ink droplets starts.

11. An ink jet recording apparatus comprising:

a recording head in which when a plurality of pressure generation elements corresponding to a plurality of nozzle openings, respectively, pressurize ink in a pressure generation chamber connected to said nozzle opening, ink droplets are discharged to a recording medium through said nozzle opening;

drive signal generation means for generating a drive signal to be applied to said pressure generation element;

temperature detection means for detecting a temperature of said recording head by every predetermined number of raster at a predetermined timing; and temperature correction means for adjusting a drive waveform of said drive signal based on the detecting result of the temperature by said temperature detection means, so that the amount of the ink droplets becomes constant without dependence on the temperature.

12. An ink jet recording apparatus comprising:

a recording head in which when a plurality of pressure generation elements corresponding to a plurality of nozzle openings, respectively, pressurize ink in a pressure generation chamber connected to said nozzle opening, ink droplets are discharged to a recording medium through said nozzle opening;

drive signal generation means for generating a drive signal to be applied to said pressure generation element;

temperature detection means for detecting a temperature of said recording head;

detection timing control means for allowing said temperature detection means to detect the temperature of said recording head at a predetermined timing; and temperature correction means for performing temperature correction for drive conditions of said recording head on the basis of a temperature detection result by said temperature detection means, wherein said detection timing control means allows the temperature detection of said recording head to detect the temperature by every predetermined raster number, and wherein said detection timing control means detects the temperature of said recording head while said recording medium is fed.

13. An ink jet recording apparatus comprising:

a recording head in which when a plurality of pressure generation elements corresponding to a plurality of nozzle openings, respectively, pressurize ink in a pressure generation chamber connected to said nozzle opening, ink droplets are discharged to a recording medium through said nozzle opening;

drive signal generation means for generating a drive signal to be applied to said pressure generation element;

temperature detection means for detecting a temperature of said recording head;

detection timing control means for allowing said temperature detection means to detect the temperature of said recording head at a predetermined timing;

temperature correction means for performing temperature correction for drive conditions of said recording head on the basis of a temperature detection result by said temperature detection means, wherein said detection timing control means allows the temperature detection of said recording head to detect the temperature by every predetermined raster number;

medium type judgment means for judging whether said recording medium is a cut sheet or a continuous sheet, and on the basis of a judgment result by said medium type judgment means, said detection timing control means allows said temperature detection means to detect the temperature of said recording head every raster number corresponding to each page when said recording medium is the cut sheet, and allows said temperature detection means to detect the temperature of said recording head by every predetermined raster number when said recording medium is the continuous sheet.

14. The ink jet recording apparatus according to claim 13 wherein said medium type judgment means include:

cut sheet detection means for detecting that the cut sheet as said recording medium is disposed in a cut sheet supply port; and continuous sheet detection means for detecting that the continuous sheet as said recording medium is disposed in a continuous sheet supply port.

15. The ink jet recording apparatus according to claim 13 wherein said medium type judgment means include medium data judgment means for judging whether said recording medium is the cut sheet or the continuous sheet by judging whether or not recording data supplied from the outside includes data indicating that said recording medium is the cut sheet, or data indicating that said recording medium is the continuous sheet.

16. An ink jet recording apparatus comprising:

a recording head in which when a plurality of pressure generation elements corresponding to a plurality of nozzle openings, respectively, pressurize ink in a pressure generation chamber connected to said nozzle opening, ink droplets are discharged to a recording medium through said nozzle opening;

drive signal generation means for generating a drive signal to be applied to said pressure generation element;

temperature detection means for detecting a temperature of said recording head;

detection timing control means for allowing said temperature detection means to detect the temperature of said recording head at a predetermined timing;

temperature correction means for performing temperature correction for drive conditions of said recording head on the basis of a temperature detection result by said temperature detection means, wherein said detection timing control means allows the temperature detection of said recording head to detect the temperature by every predetermined raster number; and recording mode judgment means for detecting a recording mode with respect to said recording medium, wherein said detection timing control means switch a timing at which said temperature detection means detects the temperature of said recording head in accordance with the recording mode on the basis of a judgment result by said recording mode judgment means.

17. The ink jet recording apparatus according to claim 16 wherein the recording mod e judged by said recording mode judgment means include a high speed recording mode and a low speed highly fine mode, and when it is judged to be said high speed recording mode, said detection timing control means allows said temperature detection means to detect the temperature by a raster number unit longer than when it is determined to be said low speed highly fine mode.

18. The ink jet recording apparatus according to claim 17 wherein said detection timing control means allows said temperature detection means to detect the temperature by a first page number unit when said recording medium is the cut sheet and said high speed recording mode is judged, and by a second page number unit when said recording medium is the cut sheet and it is judged to be said low speed highly fine recording mode.

19. An ink jet recording method by a recording head in which when a plurality of pressure generation elements corresponding to a plurality of nozzle openings, respectively, pressurize ink in a pressure generation chamber connected to said nozzle openings, ink droplets are discharged to a recording medium through said nozzle openings, said ink jet recording method comprising:

generating a drive signal to be applied to said pressure generation element;

detecting the temperature of said recording head by every predetermined number of raster; and adjusting a drive waveform of said drive signal based on the detecting result of the temperature, so that the amount of the ink droplets becomes constant without dependence on the temperature.

20. A recording apparatus having a recording head in which a printing operation causes a temperature rise of said recording head, said recording apparatus comprising:

a temperature detector detecting the temperature of said recording head;

a data correction unit wherein said data correction unit corrects image data based on an output from said temperature detector;

a detection timing control unit wherein said detection timing control unit allows said temperature detector to detect the temperature of said recording head;

recording stop monitor unit wherein said recording stop monitor unit monitors whether the discharging of the ink droplets is stopped or not;

wherein based on a monitor result of said recording stop monitor unit, when the discharging of the ink droplets is stopped and immediately before the discharging operation of the ink droplets starts, said detection timing control unit allows said temperature detector to detect the temperature of said recording head.

21. An ink jet recording apparatus comprising:

a recording head in which when a plurality of pressure generation elements corresponding to a plurality of nozzle openings, respectively, pressurize ink in a pressure generation chamber connected to said nozzle openings, ink droplets are discharged to a recording medium through said nozzle openings;

a temperature detector detecting a temperature of said recording head; and a controller wherein said controller allows said temperature detector to detect the temperature of said recording head, performs temperature correction for drive conditions of said recording head based on a temperature detection result by said temperature detector, and monitors whether the discharging of the ink droplets is stopped or not, wherein based on a monitor result, when the discharging of the ink droplets is stopped and immediately before the discharging operation of the ink droplets starts, said controller allows said temperature detector to detect the temperature of said recording head.

* * * * *